US006443642B1

(12) United States Patent
Luciano et al.

(10) Patent No.: US 6,443,642 B1
(45) Date of Patent: Sep. 3, 2002

(54) MODULAR PRINTING SYSTEM

(75) Inventors: Robert A. Luciano; Raymond G. Bryan, both of Reno, NV (US)

(73) Assignee: Sierra Design Group, Reno, NV (US)

( * ) Notice: Subject to any disclaimer, the term of this patent is extended or adjusted under 35 U.S.C. 154(b) by 0 days.

(21) Appl. No.: 09/420,222

(22) Filed: Oct. 16, 1999

(51) Int. Cl.[7] ..... B41J 3/36

(52) U.S. Cl. ..... 400/88; 400/691; 400/692; 400/693; 347/108; 347/152

(58) Field of Search ..... 400/88, 82, 613.2, 400/691, 692, 693; 347/108, 109, 152, 222, 245, 263; 361/724, 725, 726, 727

(56) References Cited

U.S. PATENT DOCUMENTS 4,881,839 A * 11/1989 Grimm ..... 400/692
5,039,242 A * 8/1991 Johnson ..... 400/613.2
5,180,232 A * 1/1993 Chadima et al. ..... 400/88
5,356,231 A * 10/1994 Nakamura et al. ..... 400/636
6,042,285 A * 3/2000 Faes et al. ..... 400/624
6,088,222 A * 7/2000 Schmitt et al. ..... 361/686
6,125,028 A * 9/2000 Matsumoto ..... 361/681
6,278,472 B1 * 8/2001 Sasaki et al. ..... 347/175

* cited by examiner

*Primary Examiner*—John S. Hilten
*Assistant Examiner*—Kevin D. Williams
(74) *Attorney, Agent, or Firm*—Ian F. Burns

(57) ABSTRACT

A modular printer system comprising a support frame, a chassis, a media holder, and a printer assembly. The support frame supports the other components and may be attached to other devices. The chassis is slidably attached to the support frame so that it may be at least partially removed from the support frame thereby exposing components attached to the chassis. The chassis is adapted to hold the media holder and the printer assembly. The media holder holds media that may be printed on by the printer assembly. The printer assembly may be removed from the chassis to service the printer assembly and give fall access to the media path. The printer assembly comprises a printer for printing on the media and a controller for controlling the printer and communicating with other devices.

20 Claims, 4 Drawing Sheets

FIG. 1
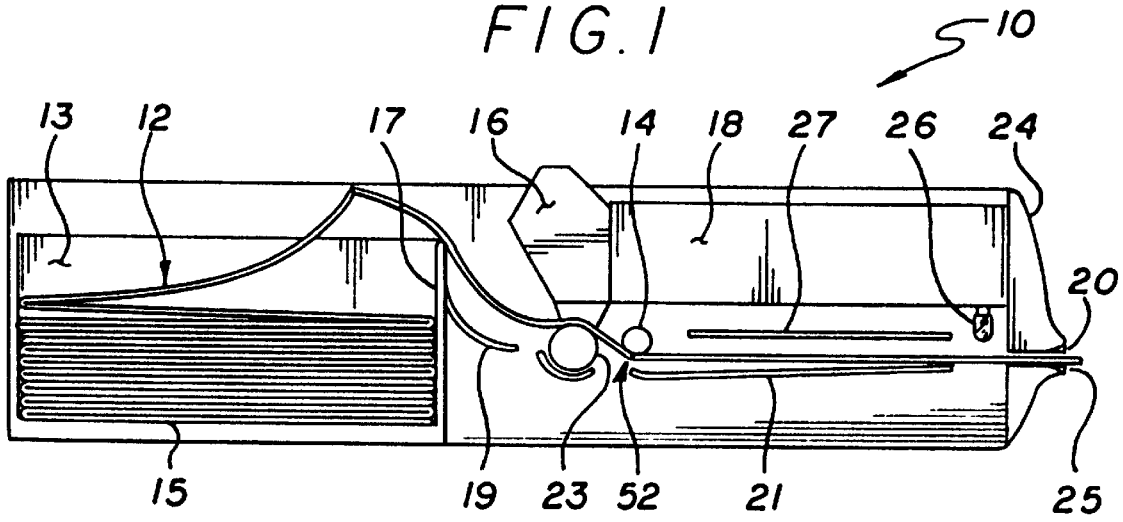
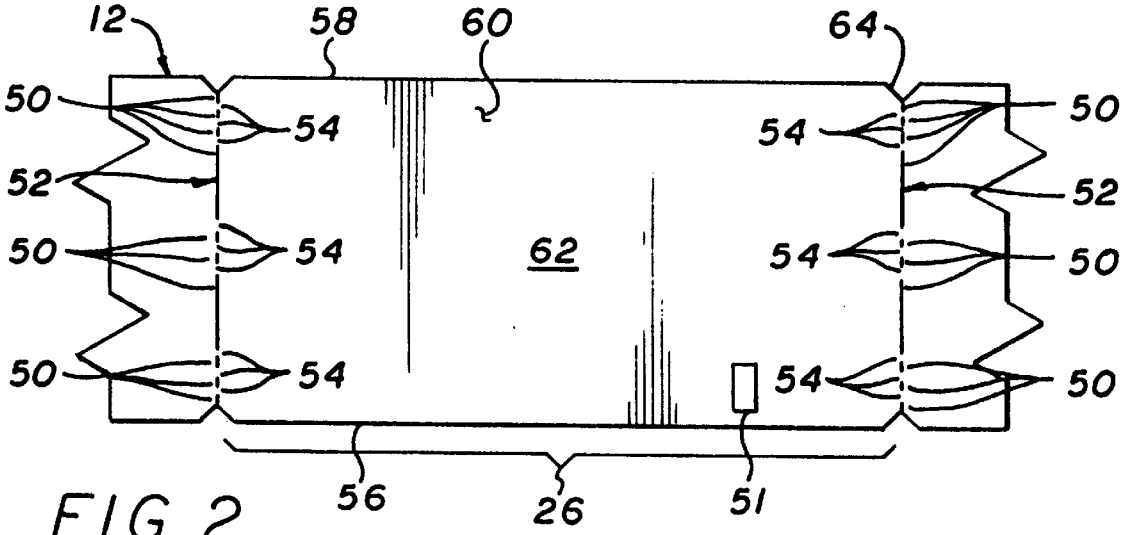
FIG. 2
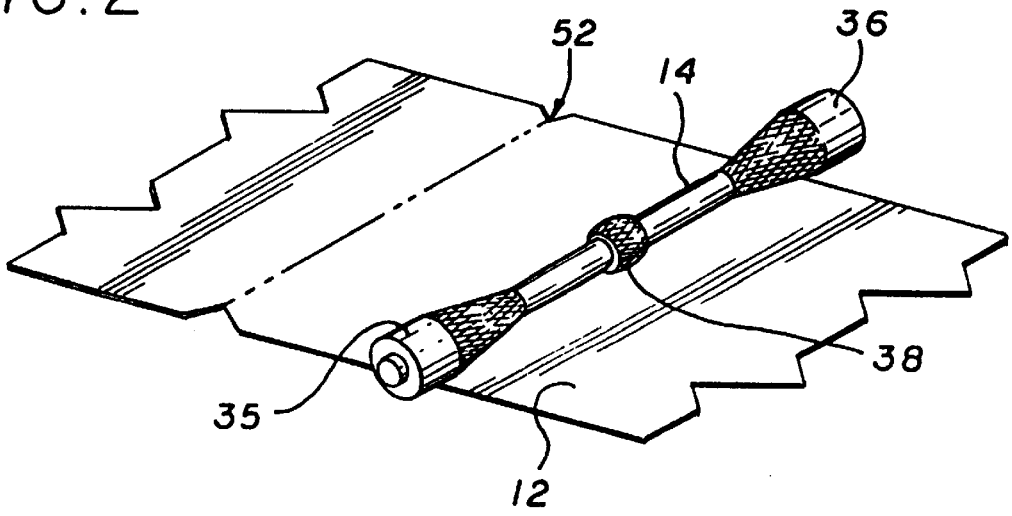
FIG. 3

FIG. 4
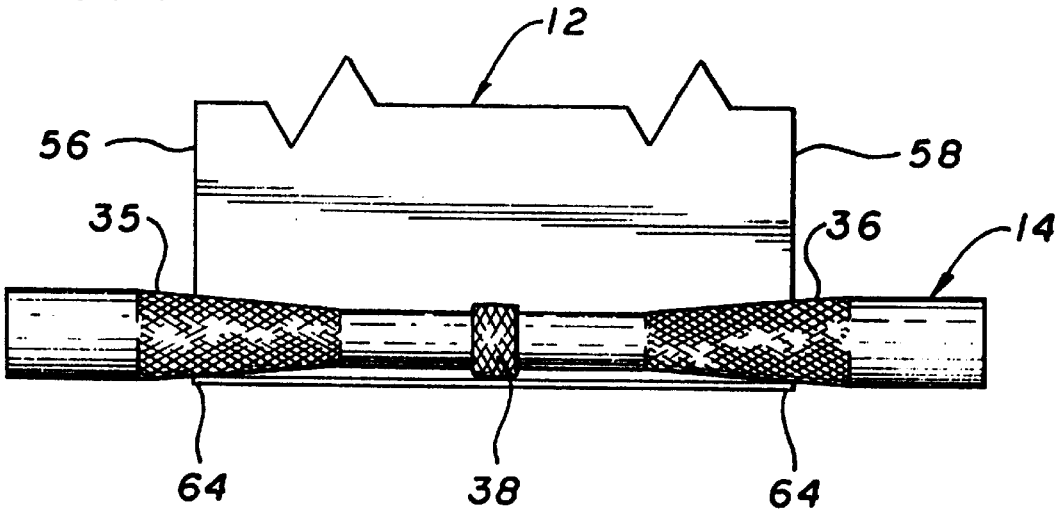
FIG. 5
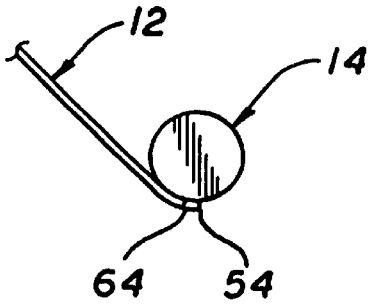
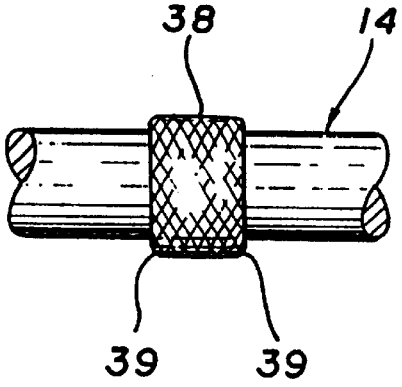
FIG. 7
FIG. 6
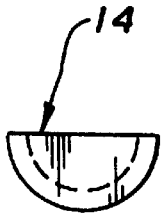

MODULAR PRINTING SYSTEM

CROSS REFERENCES TO RELATED APPLICATIONS

BACKGROUND OF THE INVENTION

1. Field of Invention

This invention relates to a modular printing system for printing and presenting tickets or vouchers.

2. Description of Related Art

Printers are now widely used to print various kinds of information bearing objects. For example, printers are used to print vouchers, tickets, coupons, receipts, and game tokens. In many of these applications it is necessary to place printers in small, in accessible spaces. For example, if a printer is used in a gaming device, the printer must occupy a minimum amount of space so that it does not interfere with the operation of other devices. In this application it is also important that a printer occupy a minimum amount of space on the front of the machine so that the space can be used to present information or entertaining graphics to the user.

Such demanding requirements present a difficult challenge to printer designers. The smaller a printer becomes, the more difficult it is to perform routine maintenance or to correct faults. The smaller the amount of space a printer occupies, the more difficult it is to access and remove the printer. What has long been needed is a printer that is small and occupies a minimum amount of space, yet is designed to allow technicians to easily access the printer and service the printers components.

SUMMARY OF INVENTION

The present invention comprises a printer system. The printer system comprises a support frame, a chassis, a media holder, and a printer assembly. The support frame is adapted to support other components of the printer system. The chassis is slidably attached to the support frame, wherein the chassis is adapted to be slid at least partially out of the support frame. The media holder is attached to the chassis and it is adapted to hold printable media. The printer assembly is removable and attached to the chassis. The printer assembly comprises a printer and a controller. The printer is adapted to print on the media and the controller is adapted to control the printer.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 1 is substantially a schematic side view of the tear bar and presenter system of the present invention.

FIG. 2 is substantially a top plan view of the media of the present invention.

FIG. 3 is substantially an isometric view of the tear bar of the present invention in use with media of the present invention.

FIG. 4 is substantially a front plan view of the tear bar of the present invention in use with media of the present invention.

FIG. 5 is substantially a left side elevational view of the tear bar of the present invention.

FIG. 6 is substantially a left side elevational view of an alternative embodiment of the tear bar of the present invention.

FIG. 7 is substantially a detailed view of the center portion of the tear bar of the present invention.

DESCRIPTION OF THE PREFERRED EMBODIMENT

Figure 8:
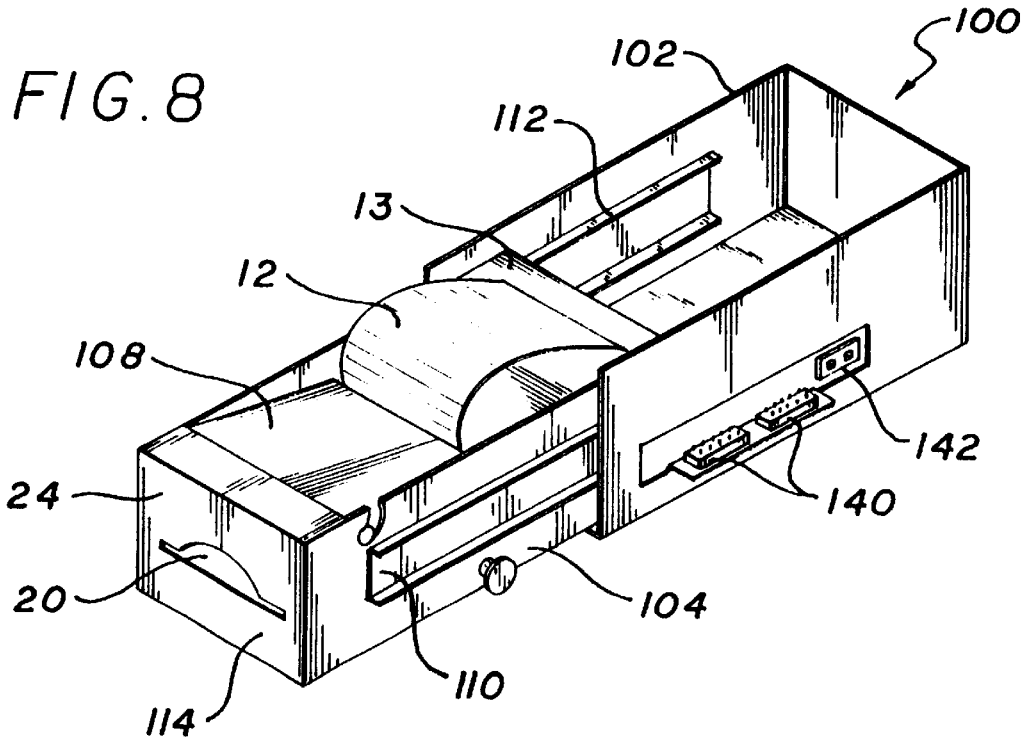
FIG. 8 is substantially a perspective view of the modular printer system of the present invention in an open position.

Referring now to FIG. 1, the present invention comprises a tear bar and presenter system generally indicated by reference number 10. System 10 comprises a strip of media 12. Media 12 is adapted to be printed on by a printer and separated into individual pieces. Media 12 is flexible enough to be thread through the printing and presenting systems of the present invention. Once printed and separated from the strip, individual pieces of media may be used as tickets, vouchers, coupons, and other information carrying objects.

Media 12 is stored in a media bin or holder 13. In the preferred embodiment, media 12 is fan-folded and a folded stack 15 is stored in bin 13. In other embodiments, media 12 is rolled, in which case means is provided for holding a roll of media and unrolling it to dispense the media. Fan folded media, however, has the advantage of producing relatively flat vouchers and occupying less space in the presently preferred embodiment.

Turning now to FIG. 2, media 12 of the present invention comprises a surface 60, first side 56, a second side 58, and a central portion 62. A plurality of perforations 50 are provided on media 12 for assisting the separation of pieces of media from each other. Perforations are preferably arranged in lines 52 that are parallel to the lateral axis of the media. Distance 26 between lines 52 is substantially the length of each voucher that may be removed from media 12. One of the advantages of the preferred embodiment is that lines 52 provide a convenient location to fan fold media 12. However, it is recognized that other perforation configurations may also be used with the present invention. For example, lines 52 may be placed at an angle to the lateral axis of the media with corresponding adjustments being made to system 10.

Perforations 50 are separated by at least one bridge of connecting material 54. In the preferred embodiment, three groups of three bridges are provided in each line 52. A first group is positioned in close relative proximity to the first side 56, a second group is positioned in close relative proximity to the second side 58, and a third group is positioned in central portion 62. It has been found that this configuration provides enough bridges of connective material to allow media 12 to be pulled from bin 13 without breaking and yet the individual pieces of media may be easily separated from the strip of media. Other bridge configurations may also be used with the present invention. For example, only two bridges may be utilized.

Media 12 may also comprise chamfered corners 64 at each line 52. When an individual voucher is removed from media 12, it has a chamfer 64 on each of its corners. Chamfers 64 allow individual vouchers to be inserted more easily into other equipment, such as a voucher reader or validator, and it allows media 12 to be more easily threaded into system 10. Chamfers 64 may also be used with a sensor to detect the position lines 52. This may be used to accurately position media 12 and to ensure that information for a particular voucher is being printed entirely on that voucher. The chamfers may be formed in a number of shapes. For example, the chamfers may be single angular lines, multiple angular lines, curves, or other corner treatments. Media 12 may be made by a number of different manufacturers including Lottery Impressions, Inc. of Waterford, Mich.

Media 12 may also comprise optical reference markers (not shown) for use with an optical sensor to accurately position the media. In the preferred embodiment, media 12 is repositioned before each printing job to correct for any slippage or error.

Returning now to FIG. 1, media 12 is fed out of bin 13 over wall 17. Wall 17 may have guide portion 19 that guides media 12 to printer 16. This may be especially useful when media 12 is first being threaded into printer 16.

Printer 16 is adapted to print information on the media 12 as it is advanced past the printer. Drive wheel 23 may be provided for advancing media 12 through system 10. Drive wheel 23 may be a part of printer 16.

A large variety of information may be printed on the media 12 and the information may be presented in a number of different ways. For example, the information may be relevant to financial transactions, games, coupons, and prizes, and the information may be presented in alphabetical or numerical characters, symbols, or bar codes. Printer 16 is preferably a LabelWriter SE available from Costar Corporation in Greenwich, Conn. The entire printer assembly, including printer 16 and controller 18 is preferably a Series 700 printer assembly available from TransAct Technologies, Inc., of Wallingford, Conn. However, a large variety of other printers may also be used. It is understood that printer 16 may imprint ink or similar dye onto media 12, it may change a property of the media to create visible characters (e.g., heating the media), it may form holes through the media to render it machine readable, or it may code magnetic information onto a magnetic strip or the like on the media.

A printer controller 18 is provided for controlling printer 16. Controller 18 may be mechanical or electronic depending on the type of printer. Controller 18 may perform other functions, such as controlling lights and communicating with other devices, such as a computer or gaming device.

As media 12 is advanced, it is fed underneath a tear bar 14 and controller 18 through opening 20. One or more guides 21 and 27 may be provided for guiding media 12 along this path. Opening 20 is the front of the machine where media 12 is presented to a user. Media 12 is advanced so that line 52 is positioned next to tear bar 14. In the preferred embodiment, tear bar 14 is positioned a predetermined distance from opening 20 so that approximately one-half inch of media 12 is advanced past the opening. It has been found that presenting approximately one-half inch of media 12 to a user substantially reduces the likelihood that a user will prematurely grasp and pull the media. This reduces the chance that a voucher will be printed incorrectly due to slippage and acceleration.

The configuration of system 10 provides that a voucher is completely printed and line 52 is past printer 16 before any of the media is exposed to the user. This prevents a user from grasping and pulling media 12 until after printer 16 has finished printing. Of course, the spatial relationship of printer 16, tear bar 14, and opening 20 is dependent on the distance 26 between lines 52 of media 12.

System 10 may also comprise bezel 24 to provide an attractive appearance to users and to limit access to opening 20. A recess 25 may be provided in bezel 24 to allow users to insert their fingers to grasp media 12.

Light source 26 may be provided near media 12 in a position adjacent to opening 20 to illuminate media 12. Light source 26 may be activated by controller 18 when media 12 is available for a user to grasp. Light source 26 may prevent a user from prematurely grasping and pulling on media 12 because the users attention is brought to the media only after the media has been properly positioned.

The present invention also provides means for advancing media 12 rapidly so that it is more difficult for users to grasp the media until it is in a proper position. During a printing operation, media 12 is generally advanced relatively slowly to accommodate printer 16. However, if media 12 is advanced at this slow rate when the media begins to extend out of opening 20, then it is possible for users to grasp the media and pull on the media before it has reached its fully extended position. To counter this, the present invention advances media 12 at a higher rate after printer 16 has finished printing.

Turning now to FIGS. 3, and 4, tear bar 14 is provided for assisting the separation of a voucher from media 12. Tear bar 14 comprises a first side portion 35, a second side portion 36 and a central portion 38. First side portion 35 is adapted to abut surface 60 adjacent to first side 56. Second side portion 36 may is adapted to abut surface 60 adjacent to second side 58. Center portion 38 is located between first and second side portions 35 and 36 and it is adapted to abut surface 60 at center portion 62. In the preferred embodiment, the three groups of three bridges 54 roughly correspond to the positions of first side portion 35, second side portion 36, and center portion 38. Thus, when a pulling force is applied by a user to media 12, first and second side portions 35 and 36 and center portion 38 provide friction and stress is applied to bridges 54.

First side portion 35 may be provided with tapered surfaces so that its height or thickness decreases as the portion is traversed from the first side towards the center of tear bar 14. Similarly, second side portion 36 may be provided with tapered surfaces so that its height or thickness decreases as the portion is traversed from the second side towards the center of tear bar 14. This configuration tends to concentrate stress on a single outer bridge 54 rather than a plurality of bridges when a pulling force is applied. When stress is concentrated on a single bridge 54, the bridge tends to break more quickly and cleanly. Once the outer most bridge 54 breaks, stress is transferred to the next bridge until it breaks. This configuration also works well with users who produce a torque by pulling on a corner of media 12 because the torque tends to concentrate the stress even more on an outer bridge 54.

First and second side portions 35 and 36 and center portion 38 may have roughened surfaces to produce more friction. The roughened surface may be produced by knurling, diamond coating, or by other means that are well known in the art. The roughened surfaces help keep the media in place when a pulling force is applied thereby creating stress on bridges 54 and it helps keep the next piece of un-printed media stationary.

As seen in FIG. 5, in the preferred embodiment tear bar 14 has a substantially round cross-section. The tear bar is mounted in system 10 so that the bar does not rotate. Other configurations may also be utilized. For example, as seen in FIG. 6, tear bar 14 may have a partially circular cross-section.

Turning now to FIG. 7, center portion 38 has a height that is greater than surrounding portions of tear bar 14. The edges of center portion 38 may have rounded or tapered portions 39 to provide the stress concentrating effect discussed above.

Tear bar 14 is shown as rod or shaft-like member. This provides a convenient form for manufacturing tear bar 14. However, it is recognized that tear bar 14 may be formed from other objects. For example, tear bar 14 could be formed from a substantially planar object by forming first and second side portions 35 and 36 and center portion 38 into the surface of the planar object. If the planar object is sheet metal, the first and second side portions 35 and 36 and center portion 38 may be formed by pressing protrusions into the sheet metal.

Figure 11:
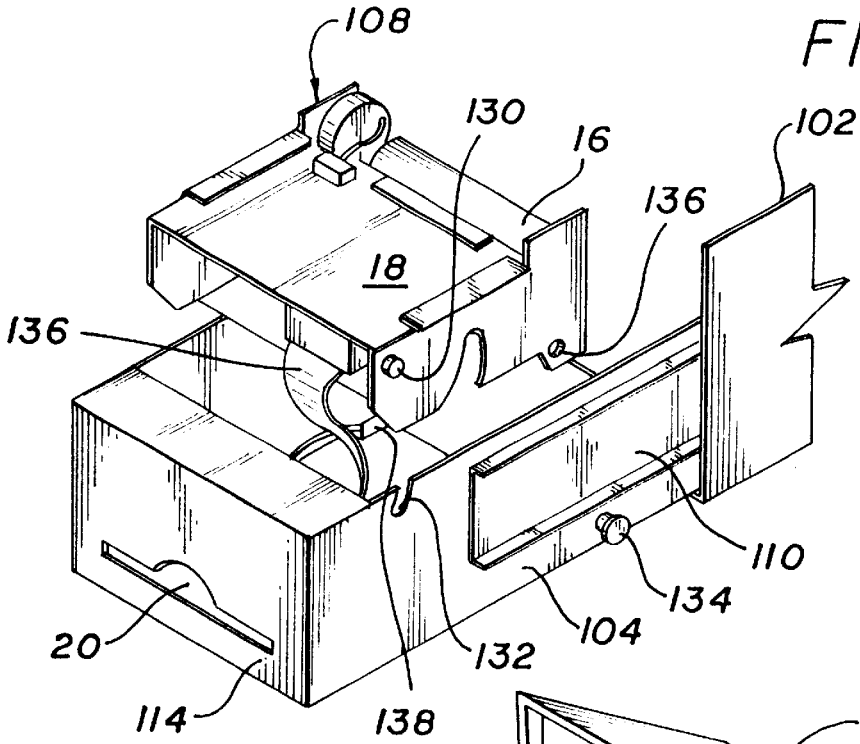
FIG. 11 is substantially a perspective view of the modular printer system of the present invetion with the printer assembly removed from the chassis.

As seen in FIG. 11, printer assembly 108 maybe attached to chassis 104 by pin 130 and groove 132. Pin 130 engages groove 132 and the groove guides assembly 108 down into its proper position. A locking mechanism 134, such a spring biased pin may engage hole 136 to lock printer assembly 108 into chassis 104. Cable 138 maybe used to transmit electrical power to printer assembly 108 from support frame 102. A connector 142 may be provided on support frame 102 for receiving power (see FIG. 8). Cable 136 may be used to transmit and receive communication signals to other devices. Connectors 140 on support frame 102 may be used to interface with other devices (see FIG. 8).

Chassis 104 is provided to support media holder 13 and printer assembly 108. Chassis 104 is adapted to be slidably removed from support frame 102. Glides 110 and 112 may be provided for allowing chassis 104 to be easily slid into and out of support frame 102. Glides 110 and 112 may be similar to standard drawer glides.

Figure 9:
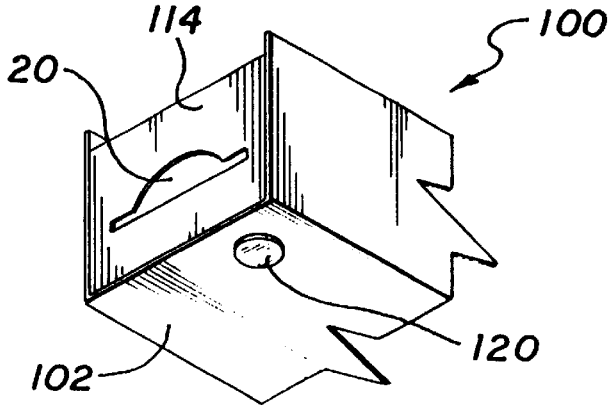
FIG. 9 is substantially a bottom perspective view of the modular printer system of the present invention in a closed position.
Figure 10:
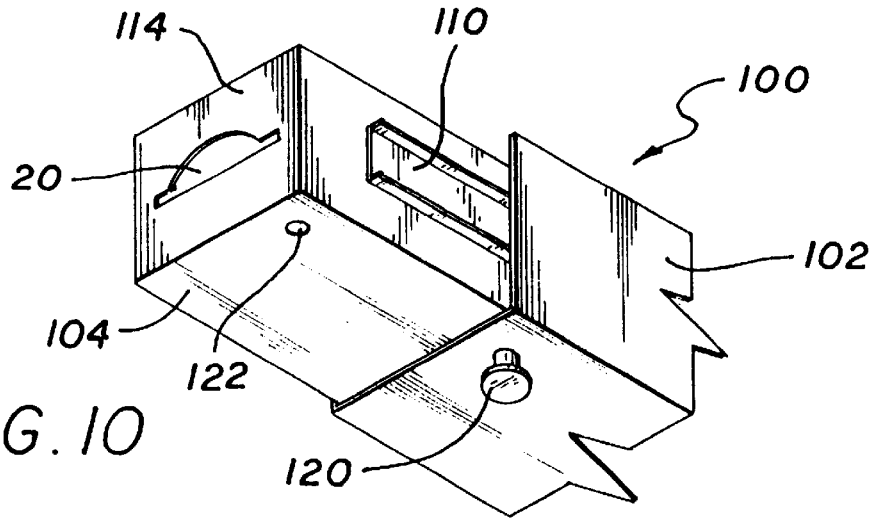
FIG. 10 is substantially a bottom perspective view of the modular printer system of the present invention in an open position.

As seen in FIGS. 9 and 10, system 100 may comprise a locking mechanism 120 for locking chassis 104 in a closed position. Locking mechanism 120 is preferably a spring biased pin that engages hole 122. The pin can be disengaged by pulling the pin downward. Once disengaged, chassis 104 may be slid outward for access to media holder 13 and printer assembly 108.

As discussed above, media holder 13 is adapted to hold a supply of media 12 to be fed to printer 16. In the preferred embodiment, media holder 13 has a substantially rectangular shape to allow it to hold fan-folded media 12. Media holder 13 is positioned at the rear of chassis 104 so that media 12 can be directed forward toward front end 114 and opening 20.

In the preferred embodiment, printer assembly 108, referring to FIG. 1, comprises printer 16, controller 18, tear bar 14, drive wheel 23, and media guide 27. However, it is recognized that one or more of these components may not be included in printer assembly 108, in which case the excluded component may be attached to chassis 104.

As seen in FIG. 11, printer assembly 108 may be attached to chassis 104 by pin 130 and groove 132. Pin 130 engages groove 132 and the groove guides assembly 108 down into its proper position. A locking mechanism 134, such a spring biased pin may engage hole 136 to lock printer assembly 108 into chassis 104. Cable 138 may be used to transmit electrical power to printer assembly 108 from support frame 102. A connector 142 may be provided on support frame 102 for receiving power (see FIG. 8). Cable 136 may be used to transmit and receive communication signals to other devices. Connectors 140 on support from 102 may be used to interface with other devices (see FIG. 8).

One of the advantages of providing printer assembly 108 is improved serviceability. In the preferred embodiment printer assembly 108 includes all of the moving parts and most of the electrical components of the system 100. Therefore, if a problem develops with system 100, a technician need only remove printer assembly 108 and replace it with a working assembly. The malfunctioning assembly may then be taken to a repair shop where it can be efficiently diagnosed and repaired. This results in a minimum amount of down time when a problem develops.

An advantage of system 100 is to fully expose the path of media 12. By removing of printer assembly 108 from chassis 104, a technician can see the entire path of media. Thus, the technician can easily clear jams and remove debris from the media path.

The entire system 100 may also be easily installed in and removed from a device. Support frame 102 may be inserted into a suitably sized hole in a device and connectors 140 and 142 may be attached to appropriate conductors.

Figure 12:
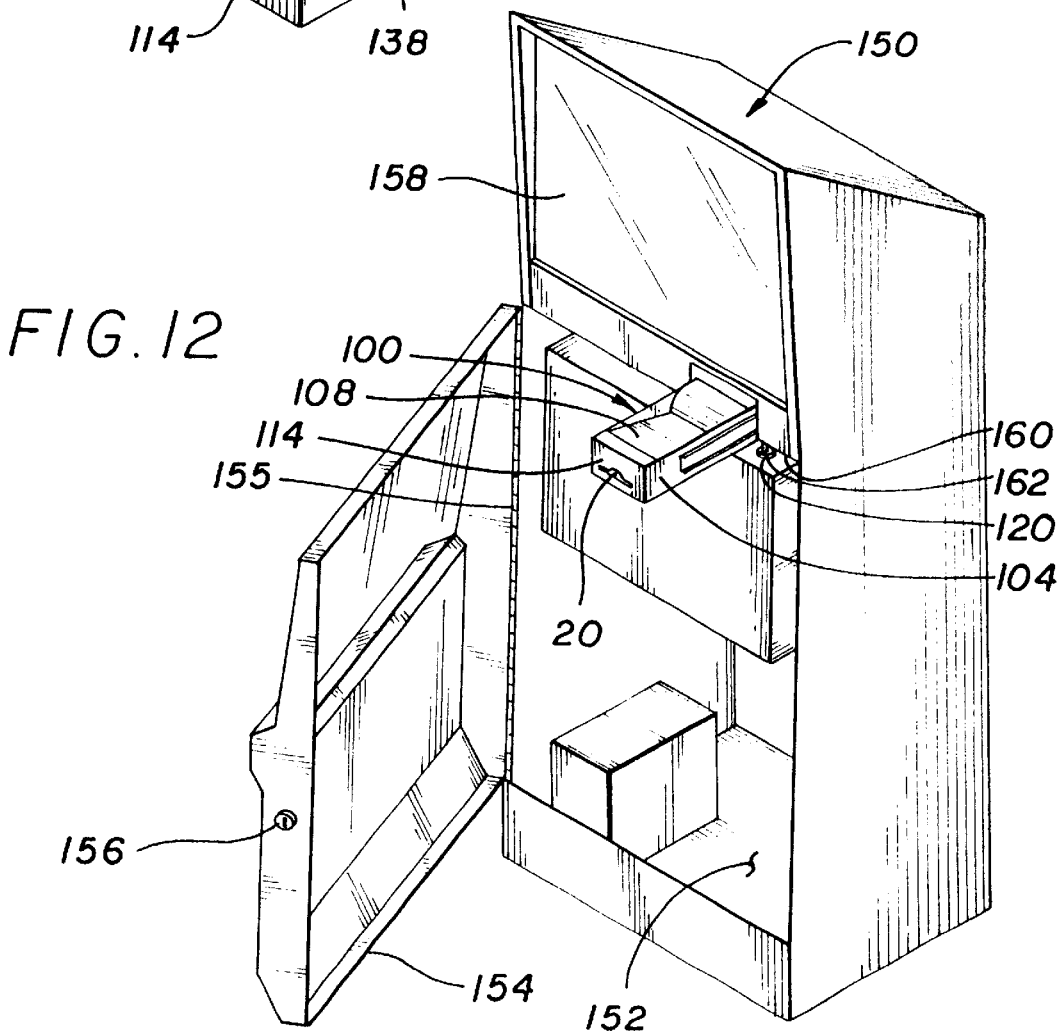
FIG. 12 is substantially a isometric view of the printer system of the present invention in use with a device having a secure compartment.

Turning now to FIG. 12, system 100 is adapted for use in a secure device 150. Device 150 may be any device with a secure compartment 152, such as a gaming device or an automatic teller machine. Compartment 152 may hold any object or mechanism that is subject to theft or tampering. Compartment 152 comprises a door 154 with hinge 155 and a locking mechanism 156. Locking mechanism 156 may be any lock device, such as a mechanical lock that is actuated by a key, an electronic lock that is actuated by an electronic key, or a combination of both.

System 100 may be mounted in an upper compartment 158 that is not necessarily secure. Secure compartment 152 and upper compartment 158 may be separated by a wall 160. System 100 is mounted on wall 160 and a hole 162 is provided in the wall for allowing locking mechanism 120 to extend below the wall.

In normal operation, a technician would access system 100 by unlocking locking mechanism 156 and opening door 154. The technician would then unlock locking mechanism 120. If the locking mechanism 120 is a spring biased pin disclosed in FIGS. 9 and 10, the technician would pull the pin downward. The technician may then slide chassis 104 outward to gain access to media holder 13 and printer assembly 108.

SUMMARY

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A printer system comprising:

(A) a support frame, the support frame being adapted to support the printer system;

(B) a chassis slidably attached to the support frame, the chassis having a pair of sides;

(C) a pair of glides attached between the sides of the chassis and the support frame, the chassis adapted to be slid at least partially out of the support frame by sliding the chassis on the glides, the glides supporting the chassis when the chassis is partially slid out of the support frame;

(D) a media holder attached to the chassis, the media holder being adapted to hold printable media;

(E) a locking mechanism for securing the chassis in a closed position on the support frame; and (F) a printer assembly removably attached to the chassis, the printer assembly comprising:

(a) a printer, the printer being adapted to print on the media; and (b) a control circuit, the control circuit being adapted to control the printer.

2. The printer system of claim 1 wherein the printer system further comprises a front end, the media holder and the printer assembly being positioned in the chassis, in a tandem arrangement, the printer assembly being positioned in front of the media holder relative to the front end of the printer system.

3. The printer system of claim 1 wherein media from the media holder is directed at least partially below the printer assembly, at least part of a media path being exposed when the printer assembly is removed from the chassis.

4. The printer system of claim 1 wherein the locking mechanism is a spring loaded pin attached to the support frame that engages a hole in the chassis.

5. The printer system of claim 4 wherein the printer assembly is guided into position in the chassis by a pair of pins attached to the printer that engage a pair of grooves located in the sides of the chassis.

6. The printer system of claim 5 wherein a second locking mechanism locks the printer in the chassis.

7. The printer system of claim 6 wherein the second locking mechanism is a second spring loaded pin attached to the chassis that engages a hole in the printer.

8. A printer system comprising:

(a) a support frame adapted to support components of the printer system;

(b) a chassis, the chassis having front and rear portions and a side;

(c) at least one glide attached between the side of the chassis and the support frame, the chassis adapted to be slid at least partially out of the support frame by sliding the chassis on the glide, the glide supporting the chassis when the chassis is partially slid out of the support frame;

(d) a media holder in the rear portion of the chassis, the media holder being adapted to store printable media; and (e) a printer assembly removeably attached to the front portion of the chassis, the printer assembly being adapted to print on the printable media and the printer assembly being removable from the printer system.

9. The printer system of claim 8, wherein the printer assembly comprises:

(a) a printer adapted to print on printable media;

(b) a controller for controlling the printer;

(c) a tear bar for tearing the printable media;

(d) a drive wheel for advancing the printable media through the printer system; and (e) a media guide for guiding the printable media through the printer system.

10. The printer system of claim 8, further comprising a locking mechanism for securing the chassis in a closed position on the support frame.

11. The printer system of claim 10 wherein the locking mechanism is a spring loaded pin attached to the support frame that engages a hole in the chassis.

12. The printer system of claim 8 wherein the printer assembly is guided into position in the chassis by at least one pin attached to the printer assembly that engages at least one groove located in the chassis.

13. The printer system of claim 12 wherein a second locking mechanism locks the printer in the chassis.

14. The printer system of claim 13 wherein the second locking mechanism is a spring loaded pin attached to the chassis that engages a hole in the printer assembly.

15. The printer system of claim 8 wherein the media travels along a media path from the media holder to the printer assembly, wherein the path may be viewed when the printer assembly is removed from the chassis.

16. A printer system comprising:

(a) a support frame adapted to support components of the printer system;

(b) a chassis attached to the support frame, at least one glide attached between the chassis and the support frame, the chassis having a front portion and a rear portion, the chassis having a media holder in the rear portion of the chassis, the media holder being adapted to hold and dispense media, wherein the chassis may be at least partially slid out of the support frame while being attached to the support frame;

(c) media, the media being adapted to be printed on;

(d) an opening in the chassis, the opening allowing the media to be dispensed to a user; and (e) a printer assembly removeably attached to the front portion of the chassis, the printer assembly being adapted to print on the media;

wherein the media travels from the media holder to the front portion of the chassis where it may be printed on by the printer assembly and dispensed to a user, wherein the printer assembly may be removed from the chassis to view the entire path of the media from the media holder to the opening.

17. The printer system of claim 16 wherein the printer assembly may be completely removed for a servicing and another printer assembly may be inserted in its place.

18. The printer system of claim 16 further comprising at least one glide attached to the chassis and the support frame, wherein the chassis may be at least partially removed from the support frame by sliding the glide.

19. The printer system of claim 16 further comprising a locking mechanism adapted to lock the chassis in at least one position to the support frame.

20. The printer system of claim 16, wherein the printer assembly comprises:

(a) a printer adapted to print on printable media;

(b) a controller for controlling the printer;

(c) a tear bar for tearing the printable media;

(d) a drive wheel for advancing the printable media through the printer system; and (e) a media guide for guiding the printable media through the printer system.

* * * * *